United States Patent [19]

Lange

[11] 3,998,062

[45] Dec. 21, 1976

[54] SEA FLOOR SUPPORTED STRUCTURES WITH CRUSHABLE SUPPORT

[75] Inventor: Kenneth Wilson Lange, Burr Ridge, Ill.

[73] Assignee: Chicago Bridge & Iron Company, Oak Brook, Ill.

[22] Filed: June 23, 1975

[21] Appl. No.: 589,716

[52] U.S. Cl. ..... 61/50; 61/98; 61/101; 52/167; 220/18; 220/69; 248/23; 248/188.3

[51] Int. Cl.[2] ..... E02D 5/00; E02B 17/02

[58] Field of Search ..... 61/50, 46; 248/188.3, 248/23; 220/69, 18; 52/167, 232

[56] References Cited

UNITED STATES PATENTS

| | | | |
|---|---|---|---|
| 2,871,616 | 2/1959 | Sundell | 248/188.3 |
| 2,876,979 | 3/1959 | Barbera | 248/358 AA |
| 3,626,702 | 12/1971 | Monaman | 61/50 |
| 3,659,814 | 5/1972 | Rode | 248/23 |
| 3,680,275 | 8/1972 | Pomlet et al. | 52/227 |
| 3,886,753 | 6/1975 | Birdy et al. | 61/46.5 |

FOREIGN PATENTS OR APPLICATIONS

| | | | |
|---|---|---|---|
| 4,514,334 | 5/1970 | Japan | 52/167 |

*Primary Examiner*—Paul R. Gilliam
*Assistant Examiner*—Alex Grosz
*Attorney, Agent, or Firm*—Merriam, Marshall, Shapiro & Klose

[57] ABSTRACT

The improvement in an offshore structure having a rigid base adapted to rest on a sea floor comprising a crushable supporting means mounted beneath the base and projecting downwardly therefrom, and adapted to be partially crushably compressed between the base and the sea floor when the structure is submerged to rest on the sea floor, thereby supporting the structure temporarily or permanently.

5 Claims, 2 Drawing Figures

SEA FLOOR SUPPORTED STRUCTURES WITH CRUSHABLE SUPPORT

Figure 1:
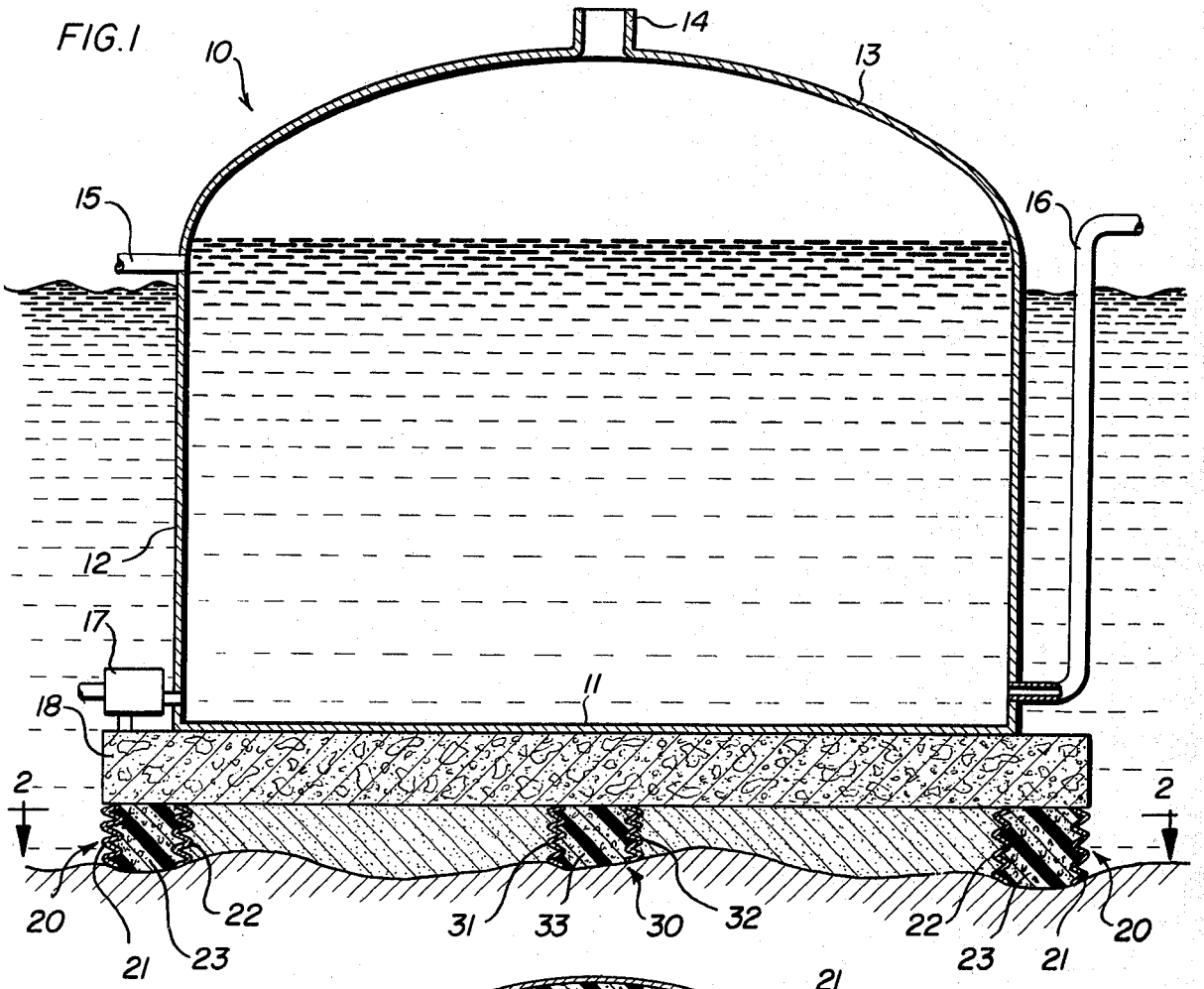

This invention relates to large offshore marine structures. More particularly, this invention is concerned with supporting rigid base offshore structures on a sea floor.

Various types of offshore structures are in use for exploring for and producing oil. In addition, offshore structures are presently in use for storing oil so that it can be subsequently carried by ship to a suitable port.

One type of offshore structure which can be used for oil exploration and production, as well as oil storage, has a rigid base which is intended to rest on the sea floor. In one particular type of such structure the rigid base is made exceedingly massive so that the structure can be secured in place primarily by the weight of the structure. See for example Davis et al. U.S. Pat. No. 3,791,152. Other structures, without a massive, but nevertheless rigid, base rely on a surcharge of liquid or solid material to temporarily or permanentaly hold the structure in place.

One of the problems encountered is in obtaining substantially uniform and adequate support for such structures on uneven sea floors. Because the sea floor is often irregular or undulating at the location where the structure is to be located it is considered necessary, in order to provide adequate support, to submerge the structure to the sea floor and then to inject a liquid grout beneath the rigid base of the structure. However, because the entire periphery of the rigid base of the structure may not be in contact with the sea floor because of its uneven surface the liquid grout could spread out beyond the edge of the rigid base and thereby not provide support for the base. It is of course obvious that the space from the periphery of the rigid base to the sea floor could be sealed after the structure is submerged and rests on the sea floor. This, however, would necessitate the use of divers to position a suitable barrier to retain the liquid grout in place until it solidifies. Working underwater, however, is hazardous and slow and the use of divers is very expensive and obviously is to be avoided if possible. A need therefore exists for an offshore structure having a rigid base which can be submerged into contact with an uneven sea floor and simultaneously will provide a supporting means for the structure and permit filling the area beneath the rigid base with a liquid grout and retain it in place until the grout solidifies.

According to the present invention, there is provided an improvement in offshore structures having a rigid base and which are adapted to rest on a sea floor, which comprises a crushable supporting means mounted beneath the rigid base and projecting downwardly therefrom. When the structure is submerged to a sea floor the supporting means is at least partially crushed and compressed between the rigid base and the sea floor, thereby supporting the structure. Although it is primarily intended that the crushable supporting means only support the structure temporarily on a sea floor, it is within the contemplation of the invention to have the supporting means in some instances be the primary or only support for a permanent installation.

The crushable supporting means will adapt itself to the sea floor contour by being crushed more in some areas than others to thereby provide the bottom of the rigid base with a supporting foundation on the sea floor.

It is generally advisable to locate the crushable supporting means at least in prt adjacent the periphery of the rigid base so that when the structure rests on a sea floor the space beneath the rigid base will be effectively sealed off from the exterior sea. As a result, the liquid grout can be placed in the space between the rigid base without it flowing or spreading beyond the peripheral edge of the base.

Figure 2:
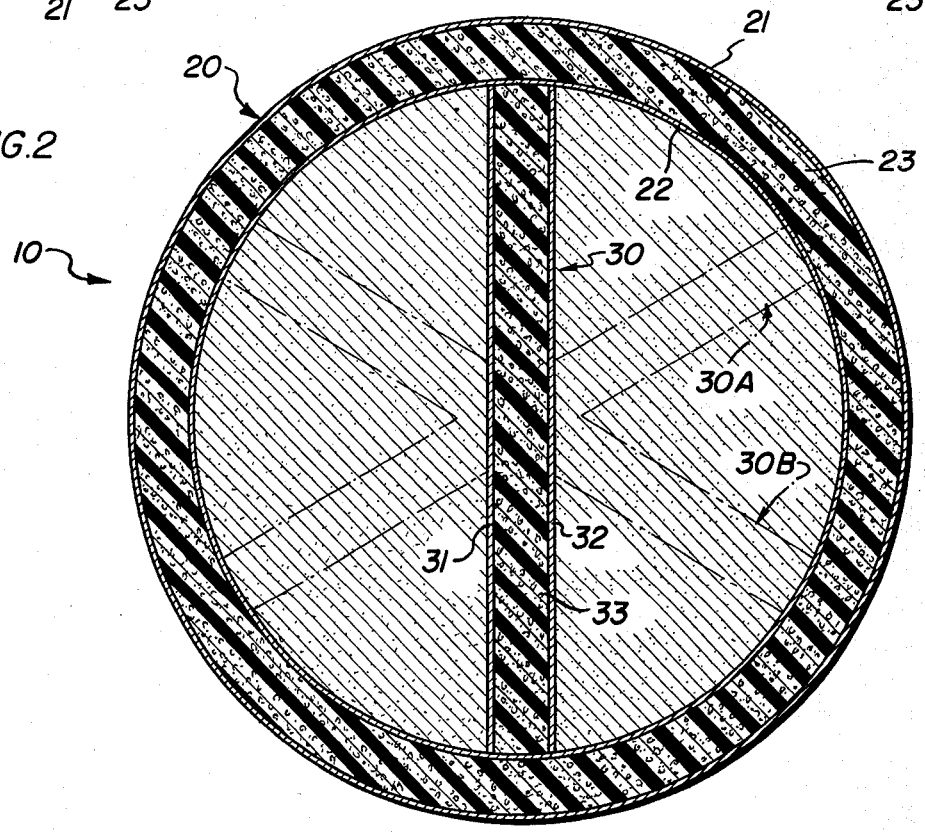

The invention will be described further in conjunction with the attached drawings, in which:

FIG. 1 is a vertical sectional view through an offshore structure resting on a sea floor; and, FIG. 2 is a sectional view taken along the line 2—2 of FIG. 1.

The structure 10 shown in the drawings has a metal bottom 11 and a vertical cylindrical walled portion 12 which is joined at its lower edge to bottom 11. Elipsoidal roof 13 is joined at its lower edges to the top of wall 12 to thereby enclose the tank. A vent opening 14 is provided in the roof to remove volatile materials. The structure 10 is filled with and emptied of oil by means of conduit 15. When oil is fed to the structure by conduit 15 the sea water is removed by conduit 16. When oil is to be removed from the structure conduit 16 is valved off and sea water is pumped in by pump 17. The oil is removed from the top by means of conduit 15.

The structure 10 has a rigid base 18 to which bottom 11 is permanently joined. Projecting downwardly from the peripheral portion of base 18 is crushable supporting means 20 positioned ring-like around the rigid base periphery. The crushable supporting means as illustrated in the drawings has a pair of spaced-apart vertical metal sheets 21 and 22. Each of these sheets is horizontally corrugated to facilitate controlled vertical crushing when the structure 10 is placed on a sea floor. The space between the corrugated sheets 21 and 22 is filled with a crushable cushioning and sealing material 23 which can be, for example, a rigid polymeric expanded or foamed material capable of withstanding the sea pressures at the depth where the structure is to rest on the sea floor.

Before the structure 10 is submerged to the sea floor the crushable supporting means 20 projects downwardly from the rigid base 18 the same distance completely around the periphery of the base. After the structure is lowered into contact with the sea floor, the crushable supporting means 20 is compressed and crushed irregularly until its bottom face acquires a contour matching the contacting contour of the sea floor. The force to crush the supporting means can be provided by the dead-weight of the structure, or by a liquid or solid surcharge supplied to the structure, or by any combination of these means. It is to be understood that as the downward pressure is applied, the structure is maintained horizontal. This results in greater crushing of the corrugated metal sheets 21 and 22 and of the cushioning material 23 in those areas beneath the rigid base of the structure where the sea floor is higher than the adjacent lower areas of the sea floor.

After the structure has been positioned on the sea floor, the space beneath the rigid base 18 within the crushable supporting means 20 can be filled with a liquid grout. In this way, additional support for the rigid base is provided. This is advisable in many instances where the structures involved are exceedingly large and which are intended to store large volumes of oil or other products. The liquid grout is retained beneath the rigid base 18 because the crushable supporting means 20 provides a seal around the periphery of the base which extends to the sea floor and prevents leakage outwardly of the liquid grout.

To further control placing liquid grout beneath very large rigid bases it is generally advisable to subdivide the space beneath the base into segments and then to fill the segments with grout. For example, a crushable supporting means 30, essentially like crushable supporting means 20, can be arranged diametrically beneath the rigid base 18 to divide the space beneath the base into two semi-circular volumes. The crushable supporting means 30 has a pair of spaced-apart vertical metal sheets 31 and 32 horizontally corrugated. The space between the two metal sheets is filled with a crushable material 33, such as with a polymeric foamed material, and specifically polyurethane foam. If it is desired to further subdivide the space beneath the rigid base 18 additional crushable supporting members 30A and 30B shown in phantom in FIG. 2 can be positioned diametrically beneath the rigid base. Each of the spaces between the crushable supporting means can obviously be filled separately with liquid grout after the structure rests on a sea floor.

The crushable supporting means as illustrated by the drawings can be used as a permanent support for a structure on a sea floor provided the size and strength of the crushing elements are made sufficiently large to provide the needed support yet sufficiently crushable to obtain a contour support between the rigid base of the structure and the sea floor. The invention is primarily useful, however, in providing a temporary support which also functions as a seal to retain liquid grout in place until it solidifies and thereby provides the main support for the offshore structure.

The foregoing detailed description has been given for clearness of understanding only, and no unnecessary limitations should be understood therefrom, as modifications will be obvious to those skilled in the art.

What is claimed is:

1. In an offshore structure having a rigid base adapted to rest on a sea floor, the improvement comprising:

a crushable supporting means mounted beneath the rigid base and projecting downwardly therefrom; and the crushable supporting means being adapted to be partially crushably compressed between the rigid base and the sea floor when the structure is submerged to rest on the sea floor, thereby adapting to and matching the contour of the sea floor and supporting the structure temporarily or permanently and creating a space, fillable with grout, between the rigid base and the sea floor bounded by the crushed supporting means in contact with the sea floor.

2. In an offshore structure having a rigid base adapted to rest on a sea floor, the improvement comprising:

a crushable supporting means arranged around and mounted beneath the periphery of the rigid base and projecting downwardly therefrom; and the crushable suppporting means being adapted to be partially crushably compressed irregularly between the rigid base and the sea floor when the structure is submerged to rest on the sea floor, thereby adapting to and matching the contour of the sea floor and supporting the structure temporarily or permanently and creating a space, fillable with grout, between the rigid base and the sea floor bounded by the crushed supporting means in contact with the sea floor.

3. In an offshore structure having a rigid noncrushable base adapted to rest on a sea floor, the improvement comprising:

a crushable supporting means mounted beneath the rigid base and projecting downwardly therefrom;

the crushable supporting means including a member arranged around the periphery of the rigid base and having spaced-apart vertical metal sheets horizontally corrugated and located on opposite sides of a crushable cushioning and sealing material; and the crushable supporting means being adapted to be partially crushably compressed between the rigid base and the sea floor when the structure is submerged to rest on the sea floor, thereby supporting the structure temporarily or permanently and creating a space, fillable with grout, between the rigid base and the sea floor bounded by the crushed supporting means.

4. The improvement according to claim 3 in which the crushable cushioning and sealing material is an expanded polymeric material.

5. The improvement according to claim 3 in which the member is arranged in a ring around the periphery of a circular rigid base.

* * * * *